US005188241A

United States Patent [19]

Kobza et al.

[11] Patent Number: 5,188,241

[45] Date of Patent: Feb. 23, 1993

[54] HANGER RECYCLER

[76] Inventors: David L. Kobza, 12 Tyler Rd., Smithtown, N.Y. 11787; Victoria Katz, 19 Millbrook Rd., Stony Brook, N.Y. 11790

[21] Appl. No.: 781,917

[22] Filed: Oct. 24, 1991

[51] Int. Cl.[5] ..... A47F 7/00

[52] U.S. Cl. ..... 211/59.1; 211/49.1; 211/113

[58] Field of Search ..... 211/49.1, 59.1, 113, 211/119, 181

[56] References Cited

U.S. PATENT DOCUMENTS

| | | | |
|---|---|---|---|
| 2,530,609 | 11/1950 | Friedman | 211/49.1 |
| 2,918,174 | 12/1959 | Tabbi | 211/49.1 |
| 3,200,960 | 8/1965 | Banse | 211/113 X |
| 3,224,596 | 12/1965 | Becker | 211/113 |
| 3,900,110 | 8/1975 | Soroka | 211/113 |
| 4,016,981 | 4/1977 | Hildt | 211/49.1 |
| 4,076,126 | 2/1978 | Gilmour | 211/59.1 |
| 4,424,905 | 1/1984 | Keen | 211/49.1 |
| 4,643,317 | 2/1987 | Wilkinson et al. | 211/113 X |
| 4,768,658 | 9/1988 | Shafto | 211/49.1 |
| 5,076,446 | 12/1991 | Simmerman et al. | 211/113 |

FOREIGN PATENT DOCUMENTS

| | | | |
|---|---|---|---|
| 719128 | 11/1954 | United Kingdom | 211/49.1 |

*Primary Examiner*—Carl D. Friedman
*Assistant Examiner*—Derek J. Berger
*Attorney, Agent, or Firm*—Galgano & Belkin

[57] ABSTRACT

Apparatus for the collection and dispensing of wire clothing hangers comprising a vertically extending column having a hook on the top and a tray at the bottom for collecting sundry items such as ties. A plurality of spaced horizontally arranged branches are mounted on the column, each branch attached at its middle to the column, each branch having mounted on the free end a pair of fingers. Each finger is attached at one end to the branch and extends out at right angles to the length of its branch at an angle above horizontal up to 45 degrees, the pair of fingers at one end of the branch being parallel to the pair of fingers at the other end and all being of the same length. The hangers are suspended by having the rungs rest on each pair of parallel fingers located at opposite ends of the branches.

4 Claims, 2 Drawing Sheets

HANGER RECYCLER

BACKGROUND OF THE INVENTION

The present invention relates to a hanger recycler and more particularly to apparatus for collecting metal clothing hangers.

Retail dry cleaning establishments dispense large numbers of wire hangers to customers each year with clothing that has been cleaned. Very few of these hangers are reused. Most of them collect in closets and eventually are disposed of as trash. Some of them are returned to the dry cleaners where they are collected in boxes for reuse. Hangers which are collected in this manner are inconvenient to use with the consequence that no serious effort is made by the dry cleaner to encourage their return.

SUMMARY OF THE INVENTION

In this invention there is provided apparatus which will conveniently collect wire hangers in a manner which encourages their reuse by dry cleaning establishments and others.

A preferred embodiment of the invention comprises a branched structure having an extended member which is suspended from the top. At the bottom of the extended member is a tray for the collection of ties, pins, etc. Branches extend outwardly from the extended member and terminate in fingers which are arranged in the form of a V. The lengths of the branches are designed to accommodate the width of the standard hanger, and the hangers are suspended from a pair of fingers on opposite ends of each branch with the hook of the hanger directed downwardly. On both ends of each branch a substantial number of hangers can be accommodated.

The fingers which are mounted on one or more of the branches may be pointed to accommodate hooded hangers, that is, hangers which are enclosed in a paper wrapping.

DESCRIPTION OF THE PREFERRED EMBODIMENT

Figure 2:
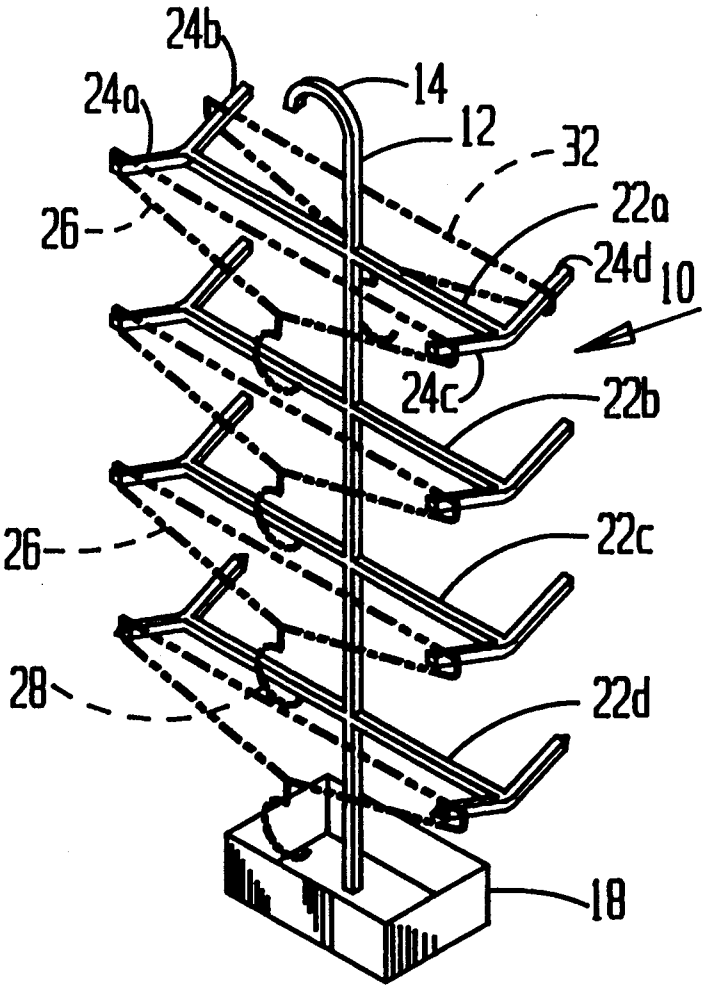
FIG. 2 is a similar view to FIG. 1 showing some hangers mounted.
Figure 1:
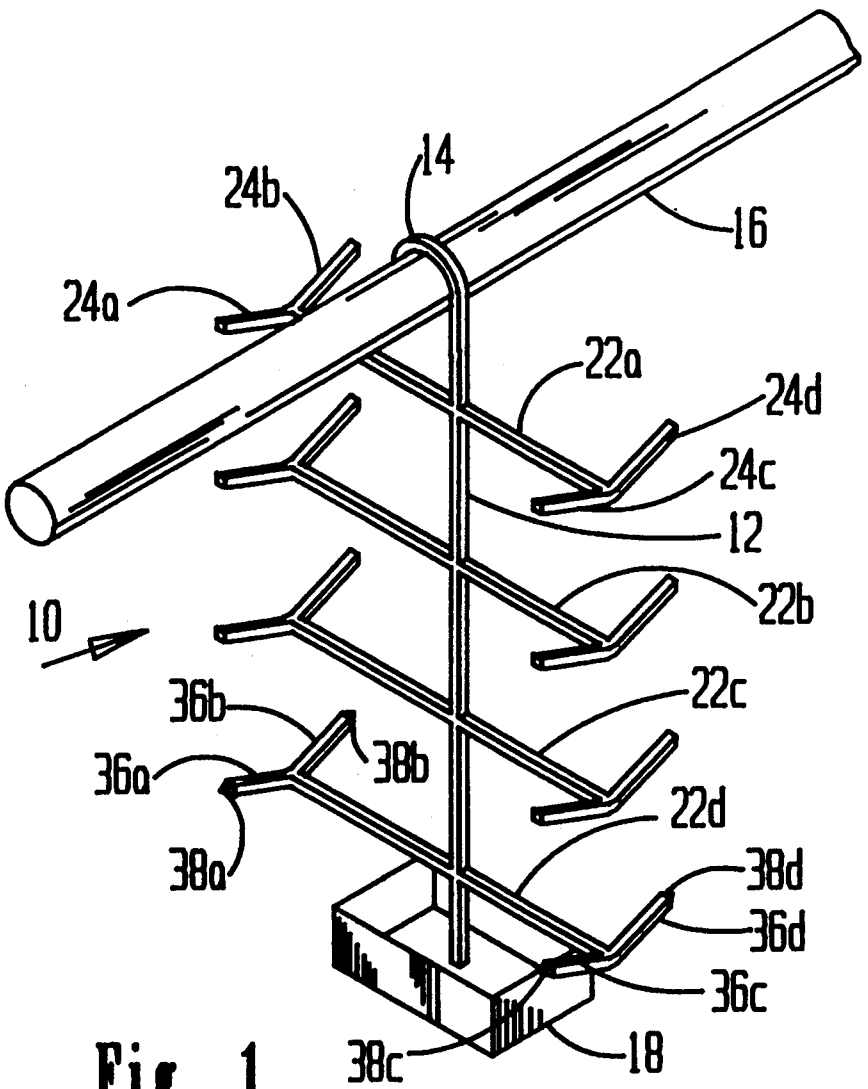
FIG. 1 is an isometric view of a preferred embodiment of this invention suspended and ready for use.

Referring to the FIGS. 1 and 2, hanger recycler 10 comprises a vertical column 12 which terminates at its top in a hook 14 for suspension from a rod 16 or other suitable member, and having at its bottom a tray or dish 18 for collecting ties, pins, etc.

Along the length of column 12 are a number of spaced branches or arms 22*a*, 22*b*, 22*c* and 22*d* which are horizontal and attached at their centers to column 12. At the ends of branch 22*a* are located pairs of fingers 24*a*, 24*b* and 24*c*, 24*d*, extending outwardly, at right angles to branch 22*a*, and upwardly, up to about 45 degrees to the horizontal. Fingers 24*a* and 24*c* are parallel to each other while fingers 24*b* and 24*d* are parallel to each other. All fingers are of identical length. Arms 22*b*, 22*c* and 22*d* are similarly provided with fingers as illustrated.

Figures 3, 4, 5:
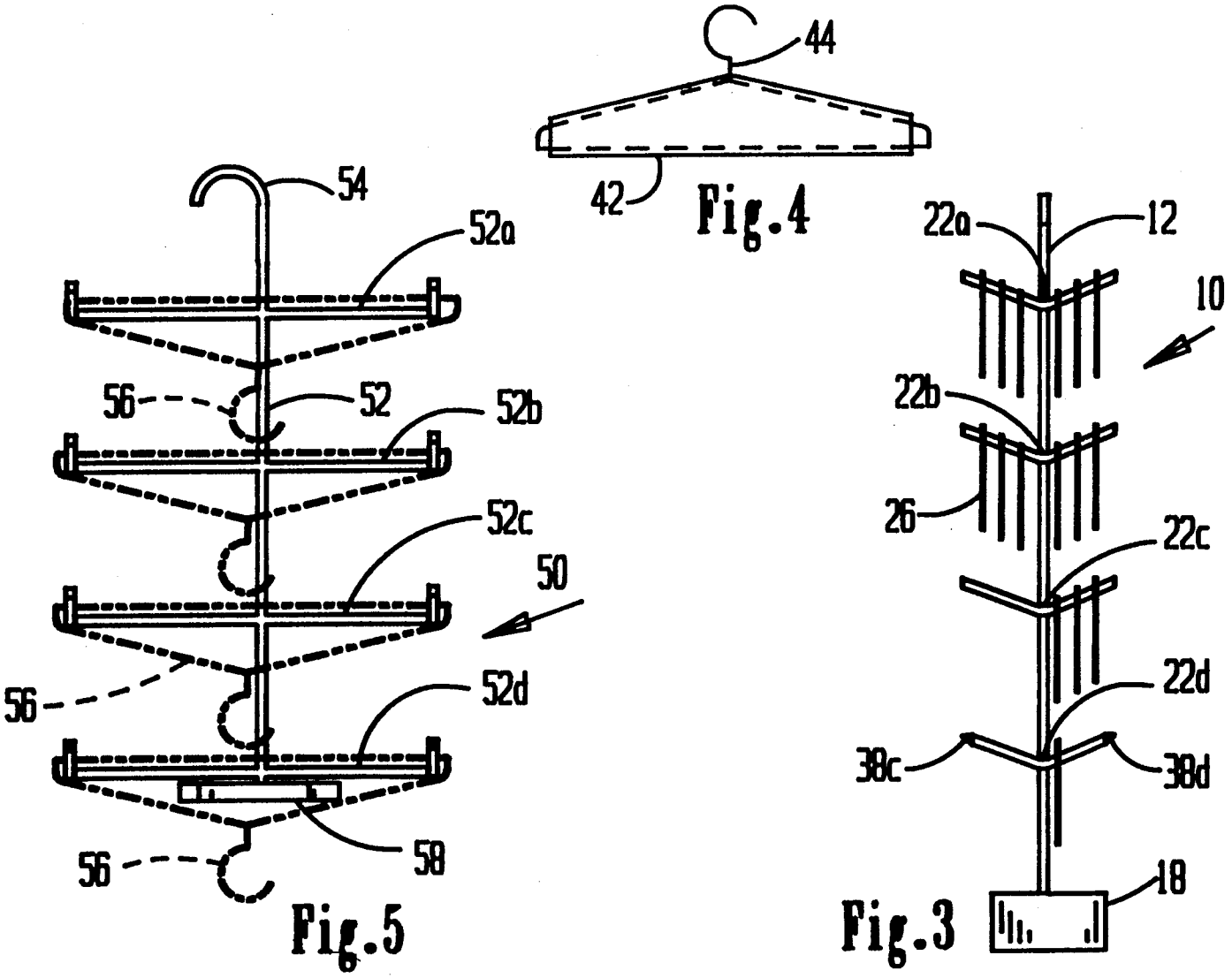
FIG. 3 is a right end view of FIG. 2, partially schematized.
FIG. 4 is an elevation, front view of a hooded hanger.
FIG. 5 is a side view with a modified arrangement at the bottom.

As seen in FIGS. 2 and 3, hangers 26 are placed upside down, with hooks 28 suspended downwardly, with rung 32 resting on parallel fingers 24*a* and 24*c*, while hangers 34 are similarly suspended from fingers 24*b* and 24*d*.

In a similar manner, hangers are suspended from the fingers on the ends of branches 22*b*, 22*c* and 22*d*, and on both sides of the branches. The spacing of branches 22*a*–22*c* is made just sufficient to accommodate the hangers without any hanger interfering with any of the hangers on the branch just below, forming multiple tiers of said hangers.

The fingers on the ends of branches 22*a*–22*d* are identical except that the fingers on one or more of the branches can be made to terminate in points such as fingers 36*a*–36*d* on branch 22*d* having points 38*a*–38*d*, respectively, to puncture the paper hoods 42 on hangers 44, as illustrated, in FIG. 3.

Referring to FIG. 5, it can be seen that hanger recycler 50, otherwise identical to recycler 10 illustrated in FIGS. 1–3, can be made shorter, if desired, by providing a smaller and shallower basket 58 which is located just under branch or arm 52*d*. Recycler 50 is provided as described earlier with a center column 52 and a hook 54, and support hangers 56. If desired, basket 58, or basket 18 shown in FIGS. 1–3 can be located anywhere along the length of the vertical column 52 or 12.

The hanger recycler described herein can be suspended in any convenient location, in the home within a closet, or in a dry cleaning establishment where it will be convenient for a worker to reach for a suspended hanger for reuse.

It is thus seen that there has been provided a useful collector of wire hangers which is convenient to store the hangers and keep them readily and conveniently available for reuse.

While only certain preferred embodiments of this invention have been described it is understood that many variations of this invention are possible without departing from the principles of this invention as defined in the claims which follow.

What is claimed is:

1. Apparatus for the collection and dispensing of and in combination with clothing hangers each wire hanger having an extended rung and a pair of side elements extending from the end of each rung and coming together to form a hook for suspending said clothes hanger, said apparatus comprising a vertically extending column having hook means on the top for the suspension thereof and tray means at the bottom thereof for collecting sundry items, a plurality of spaced horizontally arranged branches mounted on said column, each branch attached at its middle to said column and having free ends, each branch having mounted on each free end thereof a pair of fingers, each finger attached at one end to said branch and extending out at right angles to the length of its branch at an angle above horizontal, the pair of fingers at one end of said branch being parallel to the pair of fingers at the other end of said branch and all oppositely facing pairs of fingers being of the same length, the distance between the pairs of fingers at opposite ends of each branch being less than the length of the rungs on said hangers, said hangers being suspended by having the rungs thereof rest on each pair of parallel fingers located at opposite ends of said branches.

2. The apparatus of claim 1 in which said branches are spaced along said column to support without interference multiple tiers of said clothes hangers.

3. The apparatus of claim 2 in which said fingers extend at an angle in the range of up to about 45 degrees above horizontal.

4. Apparatus for the collection and dispensing of and in combination with clothing hangers each wire hanger having an extended rung and a pair of side elements extending from the end of each rung and coming together to form a hook for suspending said clothes hanger, said apparatus comprising a vertically extending column having hook means on the top for the suspension thereof and tray means at the bottom thereof for collecting sundry items, a plurality of spaced horizontally arranged branches mounted on said column, each branch attached at its middle to said column, each branch having mounted on the free end thereof a pair of fingers, each finger attached at one end to said branch and extending out at right angles to the length of its branch at an angle above horizontal, the pair of fingers at one end of said branch being parallel to the pair of fingers at the other end of said branch and all oppositely facing pairs of fingers being of the same length, the distance between the pairs of fingers at opposite ends of each branch being less than the length of the rungs on said hangers, said hangers being suspended by having the rungs thereof rest on each pair of parallel fingers located at opposite ends of said branches, at least one of said branches being provided with fingers having pointed ends for puncturing and supporting wire hangers being hooded with paper.

* * * * *